US008088469B2

(12) United States Patent
Heindl

(10) Patent No.: US 8,088,469 B2
(45) Date of Patent: Jan. 3, 2012

(54) ARRANGEMENT OF MULTIPLE SHEET PILE COMPONENTS AND WELDING PROFILE THEREFOR

(75) Inventor: Richard Heindl, Munich (DE)

(73) Assignee: Pilepro, LLC, Austin, TX (US)

( * ) Notice: Subject to any disclaimer, the term of this patent is extended or adjusted under 35 U.S.C. 154(b) by 0 days.

(21) Appl. No.: 13/069,513

(22) Filed: Mar. 23, 2011

(65) Prior Publication Data

US 2011/0171418 A1 Jul. 14, 2011

Related U.S. Application Data

(62) Division of application No. 12/151,256, filed on May 5, 2008, now Pat. No. 7,935,406.

(30) Foreign Application Priority Data

May 3, 2007 (DE) ..... 10 2007 020 747

(51) Int. Cl.
*E02D 5/02* (2006.01)
*B32B 3/06* (2006.01)

(52) U.S. Cl. ..... 428/99; 405/274; 405/277; 405/278; 405/279; 405/281; 405/285; 428/51

(58) Field of Classification Search ..... 428/99, 428/51; 405/274, 277, 278, 279, 281
See application file for complete search history.

(56) References Cited

U.S. PATENT DOCUMENTS

| | | | |
|---|---|---|---|
| 968,450 | A | 8/1910 | Conkling et al. |
| 7,168,214 | B2 | 1/2007 | Wall |
| 2005/0076595 | A1 | 4/2005 | Wall |
| 2006/0179771 | A1 | 8/2006 | Heindl |
| 2008/0219776 | A1 | 9/2008 | Heindl et al. |

FOREIGN PATENT DOCUMENTS

| | | | |
|---|---|---|---|
| DE | 1 963 243 | | 6/1971 |
| DE | 2 144 689 | | 3/1973 |
| DE | 26 31 807 | | 6/1977 |
| DE | 198 22 997 | A1 | 5/1998 |
| DE | 201 21 727 | | 12/2001 |
| DE | 202 20 446 | | 8/2002 |
| DE | 103 07 414 | A1 | 2/2003 |

(Continued)

*Primary Examiner* — Brent Ohern
(74) *Attorney, Agent, or Firm* — Karl F. Milde, Jr.; Eckert Seamans Cherin & Mellott, LLC

(57) ABSTRACT

The invention relates to an assembly of several sheet pile walls and at least one pair of connecting profiles (10, 20) with uniform cross section viewed along the longitudinal direction to connect two sheet pile walls (90, 94). In this assembly (100), the first of the two connecting profiles (10) possesses a base attached to the first sheet pile wall (90), a neck strip projecting from the base in a predetermined direction, and a head strip of larger cross section on the free end of the neck strip for engagement with a claw strip partially surrounding the head strip. The second of the two connecting profiles (2) possesses a base attached to a second sheet pile wall (90) and a claw strip to secure a head strip. The head strip of the first connecting profile (100) is thus configured both to secure the claw strip of a sheet pile (94) as a sheet pile wall and to secure the claw strip of the second connecting profile (20), while the claw strip (26) of the second connecting profile (20) serves both to secure the head strip of a sheet pile (94) as a sheet pile wall and to secure the head strip of the first connecting profile (10).

16 Claims, 7 Drawing Sheets

FOREIGN PATENT DOCUMENTS

| | | | |
|---|---|---|---|
| DE | 103 18 769 | A1 | 4/2003 |
| DE | 20 2004 018 659 | | 12/2004 |
| EP | 0 029 273 | | 11/1980 |
| EP | 1 698 733 | A1 | 2/2005 |
| FR | 884368 | | 3/1942 |
| FR | 894627 | | 12/1943 |
| JP | 54-42086 | | 12/1979 |
| JP | 56-089608 | | 7/1981 |
| JP | 56-119008 | | 9/1981 |
| JP | 57-140412 | | 8/1982 |
| JP | 57-151709 | | 9/1982 |
| JP | 57-180714 | | 11/1982 |
| JP | 58-110713 | | 7/1983 |
| JP | 63-31138 | | 11/1994 |
| JP | 2000-73361 | | 3/2000 |
| JP | 2005-171756 | | 6/2005 |

ARRANGEMENT OF MULTIPLE SHEET PILE COMPONENTS AND WELDING PROFILE THEREFOR

This application is a divisional application of U.S. patent application Ser. No. 12/151,256, filed May 5, 2008, now U.S. Pat. No. 7,935,406.

BACKGROUND OF THE INVENTION

The invention relates to an assembly of several sheet pile wall components and at least one pair of connecting profile strips with constant cross section as viewed longitudinally to join two sheet pile wall components, whereby the first of the two connecting profile strips includes a base attached to a first sheet pile wall component in the assembly, a neck strip projecting from the base along a prescribed main assembly direction, and a head strips provided on the free end of the neck strip of larger cross section onto which a claw strip partially surrounding the head strips, and the second of the two connecting profile strips includes a base attached to a second sheet pile wall component and a claw strip onto which a head strips may be hung. Further, the invention relates to a welded-on strip for use in such an assembly.

Assemblies of the type mentioned at the outset consist of sheet pile wall components such as sheet piles and carrier elements (for example, tubular piles T-carriers, and double T-carriers). The longitudinal edges of the sheet piles are equipped with lock strips that are engaged together when the sheet pile wall is erected. So-called connecting profiles equipped with corresponding locking configuration into which to secure the sheet piles serve to connect the carrier elements. The connecting profile strips are either provided with connection strips by means of which the connecting profile strip is pressed onto the form elements such as carrier flanges provided on the carrier elements, or alternatively each of the connecting profile strips is equipped with a base instead of connection strips. The connecting profile strip is attached directly to the carrier element, preferably by welding, or also by bolting or riveting, by means of this base. The connecting profile strips may also be attached to a spar of the sheet pile between the longitudinal edges provided with locks in order to be able to couple the sheet pile with, for example, another sheet pile or with a carrier element.

Further, assemblies are also erected using sheet pile wall components that are formed exclusively of carrier elements coupled together, for example tubular piles. The carrier elements are subsequently equipped with corresponding connecting profile strips in order to connect the carrier elements together. A pair of welded-on profile strips is known from DE 202 20 446 U1 that serves to connect together two tubular piles. Further, it is known from the state of the art to use slotted tubes and T-carriers as connection elements to connect tubular piles. For this, a longitudinally-slotted tube of smaller diameter is welded onto a tubular pile while the T-carrier is so attached to an adjacent tubular pile such that its T-beam is inserted into the slotted tube for connection, while the spar of the T-carrier welded to the tubular pile extends through the slot of the slotted tube.

SUMMARY OF THE INVENTION

Based on this state of the art, it is the principal objective of the present invention to provide an assembly of the type mentioned above, as well as a welded-on profile strip useable for such an assembly, that may be more universally used than is the state of the art, and that the most varied configurations of the most varied sheet pile wall components may be realized by its use.

Based on the invention, the objective is achieved in a connecting profile strip of the type described above, wherein the head strips of the first connecting profile strips serve both to secure the claw strip of a sheet pile as a sheet pile wall of the second connecting profile strip, and wherein the claw strip of the second connecting profile strip serves both to secure the head strips of a sheet pile as a sheet pile wall and to secure the head strips of the first connecting profile strip.

In the assembly based on the invention, a pair of connection element elements equipped with a so-called ball-and-socket lock configuration is used, namely a head strips on the first connecting profile strip and a claw strip on the second connecting profile strip. The head strips and the claw strip are so configured that they may directly coupled first with the head strips and claw strips of conventional sheet pile, particularly PZ and PZC sheet piles, and second, directly with one another, whereby the main assembly direction is determined by the longitudinal direction of the neck strips along which the head strips and claw strips are engaged with one another in a neutral position. This makes it possible simply to connect PZ and PZC sheet piles with carrier elements such as tubular piles and T-carriers or double-T-carriers, to which the base of each connecting profile strip is connected by means of welding, bolting, or riveting.

Thus, in an advantageous embodiment of the assembly based on the invention, it is proposed that the second connecting profile strip include a neck strip projecting along a specified main assembly direction at whose end the claw strip is provided. The additional provision of a neck strip between the claw strip and bas of the second connecting profile strip makes it possible to couple directly together carrier elements for which a minimum separation between the carrier elements must be maintained. The problem thus often exists that, because of conventional ramming and vibration tools currently available to the market by means of which sheet pile walls are driven into the ground, when installing tubular piles and double-T-carriers, adequate space must be maintained between them to allow proper operation of the tools. Provision of a properly-dimensioned neck strip for both the first and the second connecting profile strip allows tubular piles and double-T-carriers to connect them directly together and simultaneously drive them into the ground.

The neck strips of the two connecting profile strips are of such length dimensions that a defined minimum separation is maintained between the two sheet pile walls provided with the connecting profile strips when the two connecting profile strips are engaged directly with each other. This minimum distance for this is dependent on the type of tool used to drive the sheet pile walls, and preferably is approximately within the range of 160 to 200 mm, and most preferably at 180 mm.

In order to ensure the most uniform loading possible of the mounting points of the connecting profile strips, it is advantageous for the length of the neck strip of the second connecting profile strip viewed along the main assembly direction is at least approximately the same as the length of the neck strip of the first connecting profile strip. In this manner, it is ensured that the torque at the mounting points caused by cross forces perpendicular to the longitudinal direction of the connecting profile strip during the driving of the sheet pile walls into the ground at the head strips or claw strip is approximately the same, particularly when they are directly engaged with each other.

Since the sheet pile walls often tend to become twisted longitudinally because of ground conditions such as large underground rocks, it is advantageous for the locks engaged with each other allow pivoting movement to a limited extent within the locks without the lock strips engaged together may separate. Tubular piles tend to rotate slightly viewed along the longitudinal axis while being rammed into the ground. Based on the invention, it is recommended in an advantageous expansion of the assembly based on the invention to form the head strips of the first connecting profile strip such that the head strips possesses an oval or round cross section while the claw strip of the second connecting profile strip forms a lock chamber to receive the head strips in which the jaw and the lock chamber themselves are so dimensioned that the head strips and the claw strip may pivot by an angle in the range of ±15° to ±25°, preferably ±20°, about the main assembly direction without the head strips becoming separated from the claw strip.

In order to erect as strong a wall of sheet pile walls as possible, it is proposed for an embodiment of the assembly based on the invention to attach at least one of the two connecting profile strips to a sheet pile wall formed as a carrier element. For this, a tubular pile, a T-carrier, or a double-T-carrier is suitable as a carrier element. It is further conceivable to provide carriers that are directly adjacent to each other with a first and a second connecting profile strip, whereby the two connecting profile strips are directly engaged with each other. In this manner, walls of tubular piles or double-T-carriers may be erected. For this, it is of particular advantage that the length of the neck strips of the two connecting profile strips be so selected that the afore-mentioned tool may be used with no problems. It is also conceivable to attach one of the connecting profile strips directly to the sheet pile wall itself but at a separation from the longitudinal edges provided with the lock strips while the other of the two connecting profile strips is attached to a carrier element, for example a tubular pile and is engaged with the connecting profile strip attached to the sheet pile wall. A sheet pile wall of sheet piles may be simply and elegantly supported in this manner.

Alternatively, it is proposed to attach the two connecting profile strips to carrier elements and to insert at least one sheet pile between the two connecting profile strips.

The above-described assemblies may be combined with one another in several ways so that several pairs of connecting profile strips and a large number of varying sheet pile wall may be coupled together in a suitable manner.

According to an additional aspect, the invention relates to a welded-on profile strip as defined in claim 10, which may be used in the assembly based on the invention. The welded-on of has a claw strip and a welded-on base to attach the welded-on profile strip to a sheet pile wall, preferably to a carrier element. To solve the above-mentioned task, a neck strip is formed at a separation from the welded-on base along a specified assembly direction at whose end the claw strip is provided.

In an advantageous extension of the welded-on profile strip, the claw strip is formed of two arc-shaped, preferably mirror-reflected claw strips that form a lock chamber to receive a head strips and whose free ends facing each other form a jaw. The arc-shaped progression of the claw strips provide the lock chamber with an essentially round or oval cross section within which a head strips with round or oval shape is first held securely, and second, may be pivoted through a limited range that is suitable for insertion into the ground. For a head strips with oval cross section in which the main axis of the oval extends perpendicular to the main assembly direction, the lock chamber of the claw strip is preferably also oval, whereby here the main axis of the oval is also perpendicular to the main assembly direction. For this, the largest dimension of the lock chamber perpendicular to the main assembly direction is larger than the largest dimension of the head strips perpendicular to the main assembly direction by a factor of 1.2 to 1.4 times.

In order to allow adequate pivoting motion of the head strips within the claw strip, it is further proposed in a particularly advantageous embodiment to form the jaw of the claw strip such that the center lines of the free ends of the two claw strip intersect the axis of symmetry of the claw strip at a point outside the jaw. For this, the distance from this intersection point to the jaw is preferably 0.5-1.5 the value of the wall thickness of the hook strip.

According to another embodiment of the welded-on profile strip according to the invention, the claw strip of the second connecting profile strip includes a cross spar perpendicular to the longitudinal dimension and two connecting strips that extend at least approximately rectangular to the cross spar and that are at a distance from one another whose ends are shaped into hooks, whereby the free ends of the claw strip facing each other define a jaw of a lock chamber formed by the cross spar, the connecting strips, and the hook strip. In this manner, a lock chamber results that possesses a rectangular or square cross section.

The jaw width of the lock chamber is selected to be smaller than the largest dimension of the head perpendicular to the main assembly direction of the head strips to be secured, whereby the largest dimension of the head of the head strips is preferably 1.3 to 1.6 times the jaw width. The width of the lock chamber perpendicular to the main assembly direction is thus preferably 1.3 to 1.6 times the largest dimension of the head perpendicular to the main assembly direction of the head strips to be secured. The length of the lock chamber may vary according to application, and lies preferably within the range of 1.2 to 1.6 times the width of the lock chamber. If these shape properties are maintained for the lock chamber, it is first ensured that the head strips cannot escape from the lock chamber even though both pivoting movement and longitudinal movement may occur relative to the welded-on profile strip. For this, the dimension of the lock chamber viewed along the longitudinal direction of the neck strip is at least 0.5 as great as the length of the neck strip of the welded-on profile strip.

In specific application cases such as the use of the welded-on profile strip to erect sheet pile walls along waterways, it is necessary to seal the interface between head strips and welded-on profile strip. It is proposed for this purpose to provide a guide channel for a seal at the cross spar of the welded-on profile strip. Suitable seal material may be inserted via this guide channel that at least partially fills the lock chamber and thus provides a seal.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
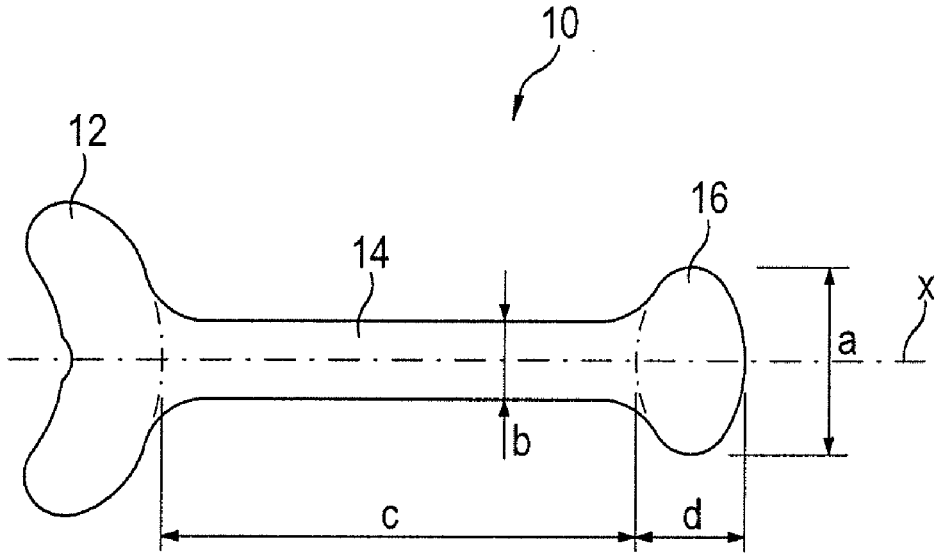
FIG. 1 top view of the front face of an embodiment of a first connecting profile strip based on the invention with a head strips, a neck strip, and a base for attachment to a sheet pile wall.

The preferred embodiments of the present invention will now be described with reference to FIGS. 1-12 of the drawings. Identical elements in the various figures are designated with the same reference numerals.

FIG. 1 is a top view of the front face of an embodiment example of a first connecting profile strip 10 based on the invention. The connecting profile strip 10 possesses constant cross section when viewed longitudinally, and is in the form of a welded-on strip. For this, the connecting profile strip 10 possesses a base 12 shown to the left in FIG. 1 that possesses a slightly arched cross-sectional shape. The arched shape of the base 12 simplifies welding of the base onto surfaces with either flat or arched cross section.

A neck strip 14 projects from the base 12 along a main assembly direction X whose free end is shaped into a head strip 16. The head strips 16 possesses an oval cross section, whereby the main axis of the oval head strips 16 extends perpendicular to the main assembly direction X. The head strips 16 matches the shape and form of a head strips of a conventional ball-and-socket connection.

The greatest dimension a of the head strips 16 along the main assembly direction X is about 2 to 2.5 times as great as the wall thickness of the neck strip 14. The length c of the neck strip 14 viewed along the main assembly direction X is approximately five times of the greatest dimension d of the head strips 16 viewed along the main assembly direction X, as is shown by the dashed imaginary projection of the oval.

Figure 2:
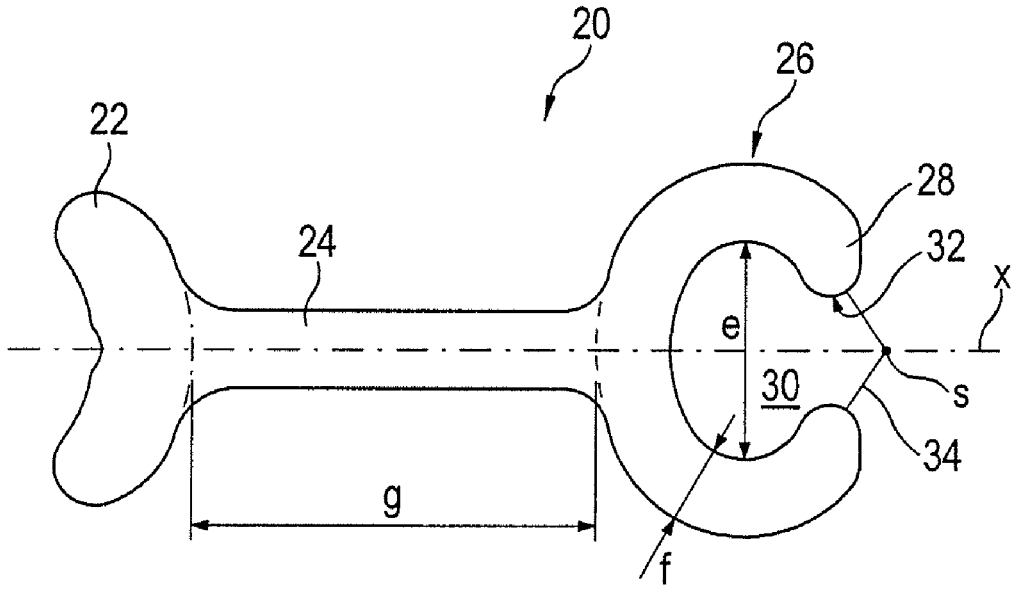
FIG. 2 top view of the front face of a first embodiment of a second connecting profile strip with a claw strip of C-shaped cross section, a neck strip, and a base for attachment to a sheet pile wall.

FIG. 2 shows a top view of the front face of a first embodiment example of a second connection profile strip 20 based on the invention. The connection profile strip 20 also possesses a base 22 with arched shape, from which a neck strip 24 projects along the main assembly direction X. A claw strip 26 with C-shaped cross section is formed at the free end of the neck strip 24.

The C-shaped claw strip 26 is formed of two arc-shaped, mirror-image claw strip 28 that form a lock chamber 30 and whose free ends pointing toward each other define a jaw 32. The arc-shaped progression of the claw strip 28 provides the lock chamber 30 with an essentially oval cross section. The lock chamber 30 is thus of such dimensions that it can receive the head strips 16 of the first connecting profile strip 10 shown in FIG. 1.

In the illustrated embodiment example, the greatest dimension e of the lock chamber 30 perpendicular to the main assembly direction X is larger than the greatest dimension a of the head strips 16 of the connecting profile strip 10 perpendicular to the main assembly direction X by a factor of 1.2.

The jaw 32 of the claw strip 26 is in turn to be shaped such that the center lines 34 of the free ends of the two claw strip 28 intersects with the axis of symmetry of the claw strip 26 at a point S outside the jaw 32. For this, the separation of the intersection point S to the jaw 32 is preferably 0.5 to 1.5 times the value profile strip the wall thickness f of the claw strip 28. The length g of the hook strip 28 essentially corresponds to the length c of the hook strip 14 of the first connecting profile strip 10

The lock chamber 30 of the claw strip 26 thus dimensioned first ensures a secure hold of the claw strip 16, while the head strips 16 on the other hand may be pivoted within a predetermined pivot range within the lock chamber 30, as will be explained later.

Figure 3:
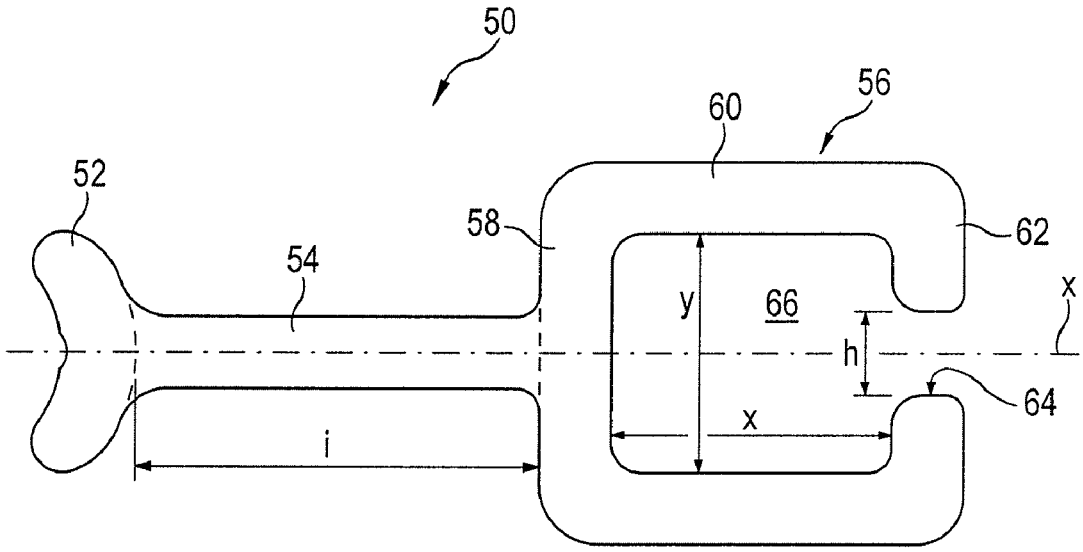
FIG. 3 top view of the front face of a second embodiment of a second connecting profile strip with a claw strip of square cross section.

FIG. 3 shows a top view of the front face of a second embodiment example of a second connecting profile strip 50 based on the invention. Here also, the connecting profile strip 50 includes a base 52 and a neck strip 54 extending along the main assembly direction X. The end of the neck strip 54 is formed into a claw strip 56 with rectangular cross section.

The claw strip 56 includes a cross spar 58 extending perpendicular to the longitudinal direction of the neck strip 54 and two straight connection element strips 60 extending at least approximately perpendicular to the cross spar 58 and separated from one another. The free ends of the two connection element strips 60 are formed into claw strip 62, whereby the free ends of the claw strip 62 are facing each other, forming a jaw 64. The cross spar 58, the two connection element strips 60, and the two claw strip 62 enclose a lock chamber 66 with rectangular cross section.

The width h of the jaw 64 profile strip the lock chamber 66 is of smaller dimension than the greatest dimension a of the head strips 16 of the first connecting profile strip 10 viewed perpendicular to the main assembly direction X. The width y of the lock chamber 66 perpendicular to the main assembly direction X is approximately 1.5 times the value of the greatest dimension a of the head strips perpendicular to the main assembly direction X, while the length x of the lock chamber 66 is approximately 1.2 times the value of the width y of the lock chamber 66. The length x of the lock chamber in the illustrated embodiment example represents about 0.5 times the value of the length I of the neck strip 54 of the connecting profile strip 50.

Figure 4:
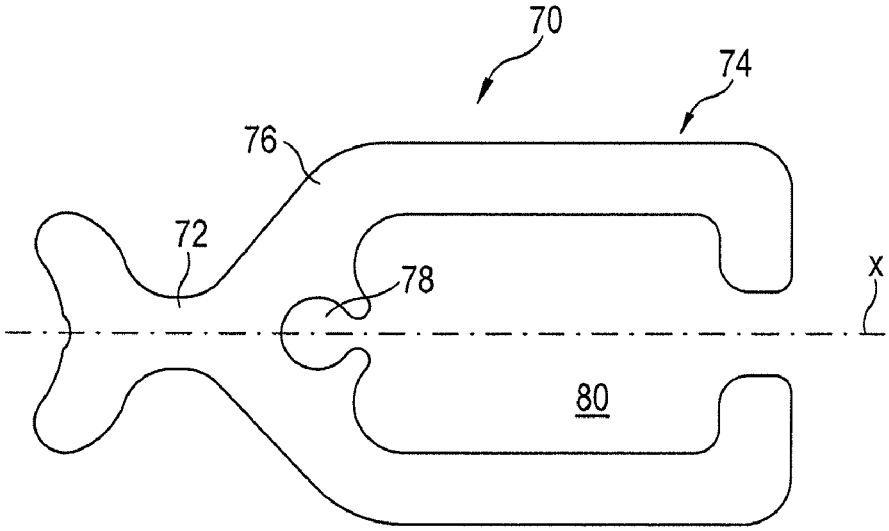
FIG. 4 top view of a mutation of the second connecting profile strip shown in FIG. 3.

FIG. 4 is a top view of a connecting profile strip 70, a mutation of the second connecting profile strip 50 shown in FIG. 2 whose neck strip 72 is formed to be shorter while the claw strip 74 is formed correspondingly longer. The essential shape characteristic of this mutation is an access channel 78 formed on the cross spar 76 of the claw strip 74, by means of which suitable seal material may be inserted that at least partially fills the lock chamber 80, thus providing a seal.

The previously-described connecting profile strips 10, 20, 50, and 70 are suited to connect different sheet pile walls such as tubular piles 90, double-T-carriers 92, and PZ or PZC sheet piles 94. Subsequently, a few minor assembly versions are shown regarding how the connecting profile strips 10, 20, and 50 may be used in combination with one another in order to couple the previously-described sheet pile walls together.

Figure 5:
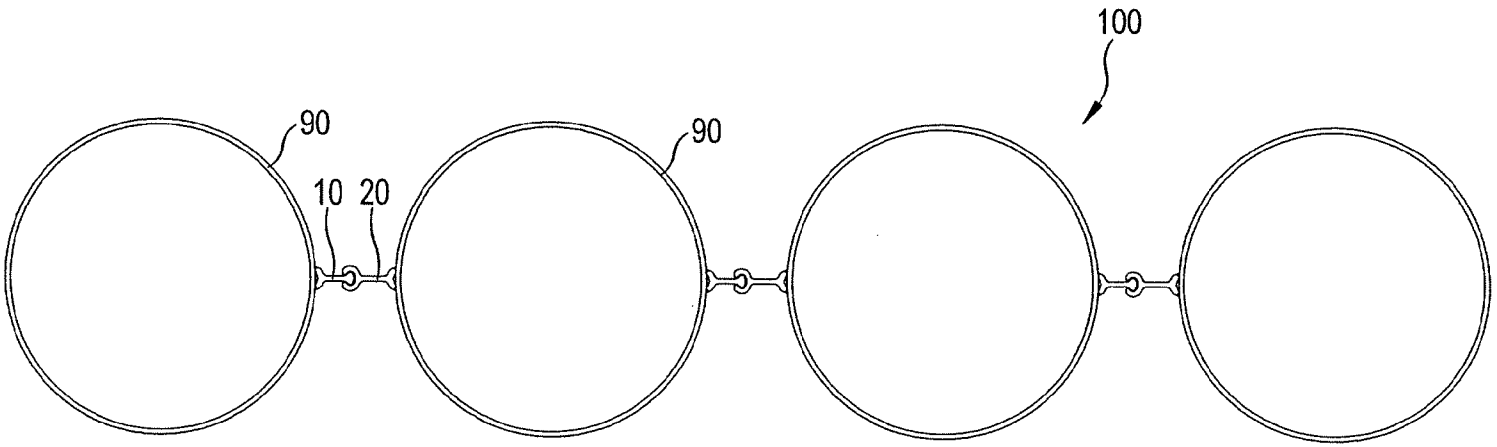
FIG. 5 top view of an assembly of several tubular piles that are coupled together by means of the connecting profile strips shown in FIGS. 1 and 2.

FIG. 5 shows in top view a first assembly 100 of several tubular piles 90. The tubular piles 90 positioned adjacent to one another are coupled together by means of the two connecting profile strips 10 and 20 shown in FIGS. 1 and 2. The connecting profile strips 10 and 20 are welded onto the mantle surface of the tubular piles 90, and extend along the entire axial length of the tubular pile 90.

Figure 6:
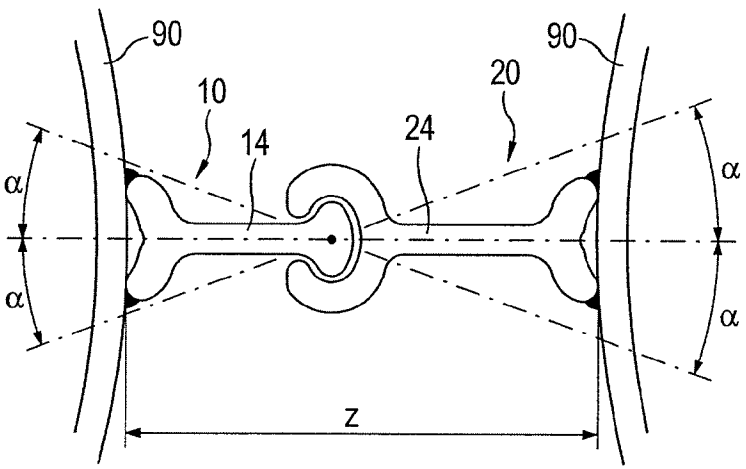
FIG. 6 enlarged top view of a detail of the assembly from FIG. 5, in which the two connecting profile strips engaged with each other are shown enlarged.

FIG. 6 shows an enlarged top view of a detail of the assembly from FIG. 5, in which the connecting profile strips 10 and 20 engaged with each other are shown in an enlargement in order to make clear that, because of the configuration of the connecting profile strips 10 and 20, first, a pivoting of the connection profile strips 10 and 20 through a pivot-angle range $\alpha$ of approximately ±20° is possible, whereby because of the lengths of the neck strips 14 and 24, the pivot point lies approximately in the center between the two tubular piles 90. Second, the tubular piles are maintained at a predetermined minimum separation distance z.

Figure 7:
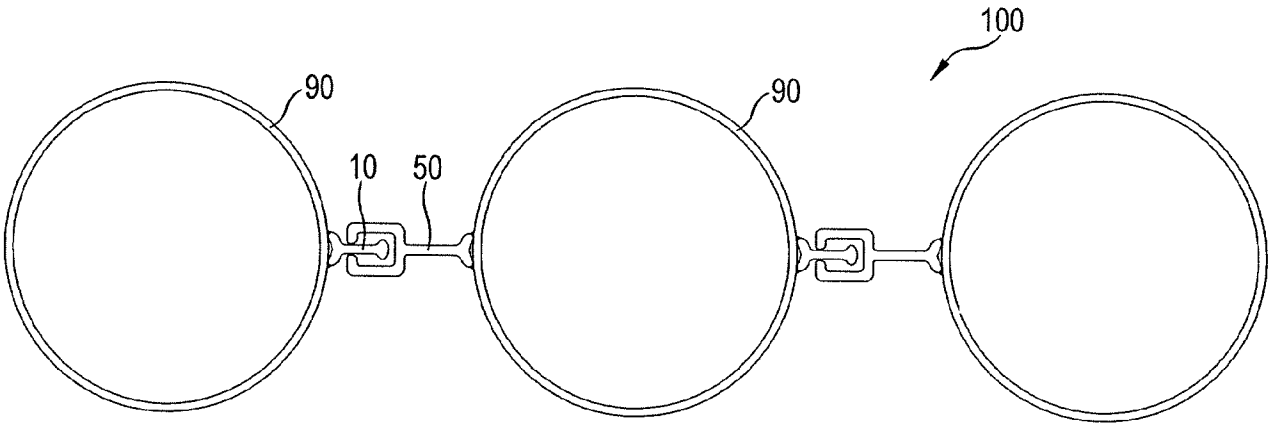
FIG. 7 top view of an assembly of several tubular piles that are coupled together by means of the connecting profile strips shown in FIGS. 1 and 3.

FIG. 7 shows a top view of a second assembly 110 of several tubular piles 90 that are coupled together by means of the connecting profile strips 10 and 50 shown in FIGS. 1 and 3. Here also, the connecting profile strips 10 and 50 are welded onto the mantle surface of the tubular piles 90, and extend along the entire axial length of the tubular piles 90.

Figure 8:
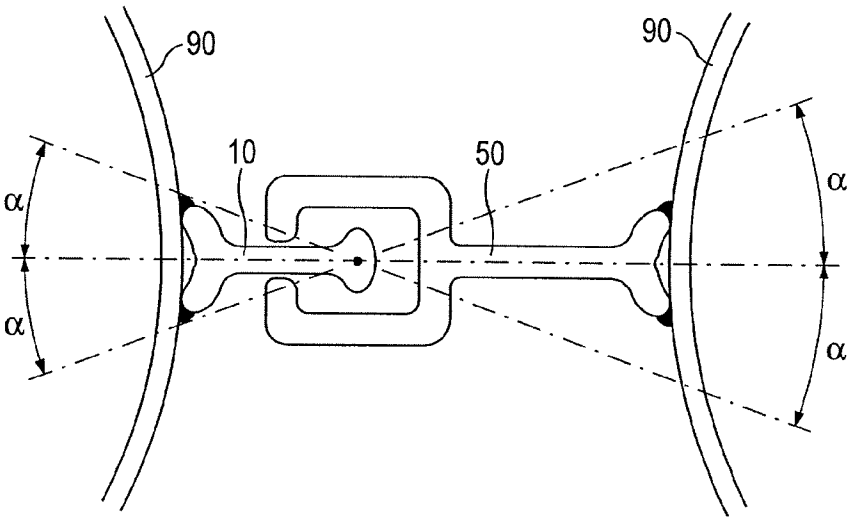
FIG. 8 enlarged top view of a detail of the assembly from FIG. 7 in which the two connecting profile strips engaged with each other are shown enlarged.

FIG. 8 shows an enlarged top view of a detail of the assembly 110 from FIG. 7, in which two connecting profile strips 10 and 50 engaged with each other are shown enlarged. As with the embodiment example shown in FIG. 6, the two connecting profile strips 10 and 50 allow pivoting movements through a pivot-angle range $\alpha$ of approximately ±20°.

Figure 9:
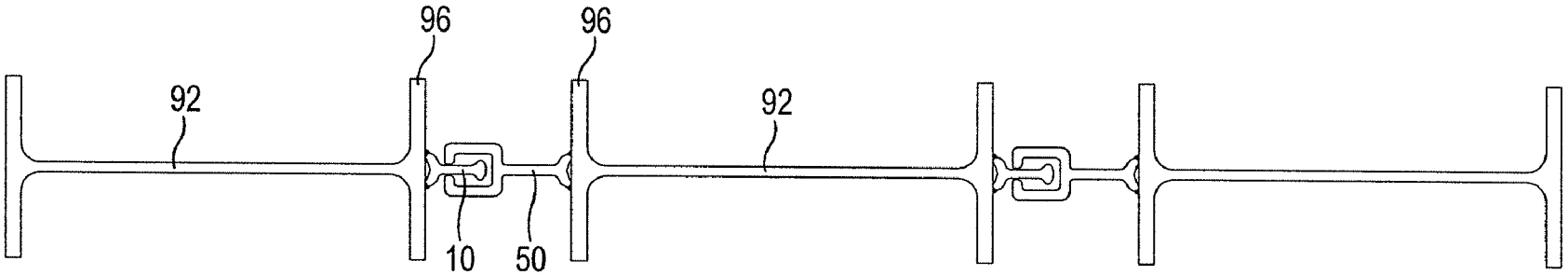
FIG. 9 top view of an assembly of several double-T-carriers whose flanges are coupled together by means of the connecting profile strips shown in FIGS. 1 and 3.

FIG. 9 is a top view of an assembly 120 of several double-T-carriers 92, whose flanges 96 are coupled together by means of the connecting profile strips 10 and 50 shown in FIGS. 1 and 3.

Figure 10:
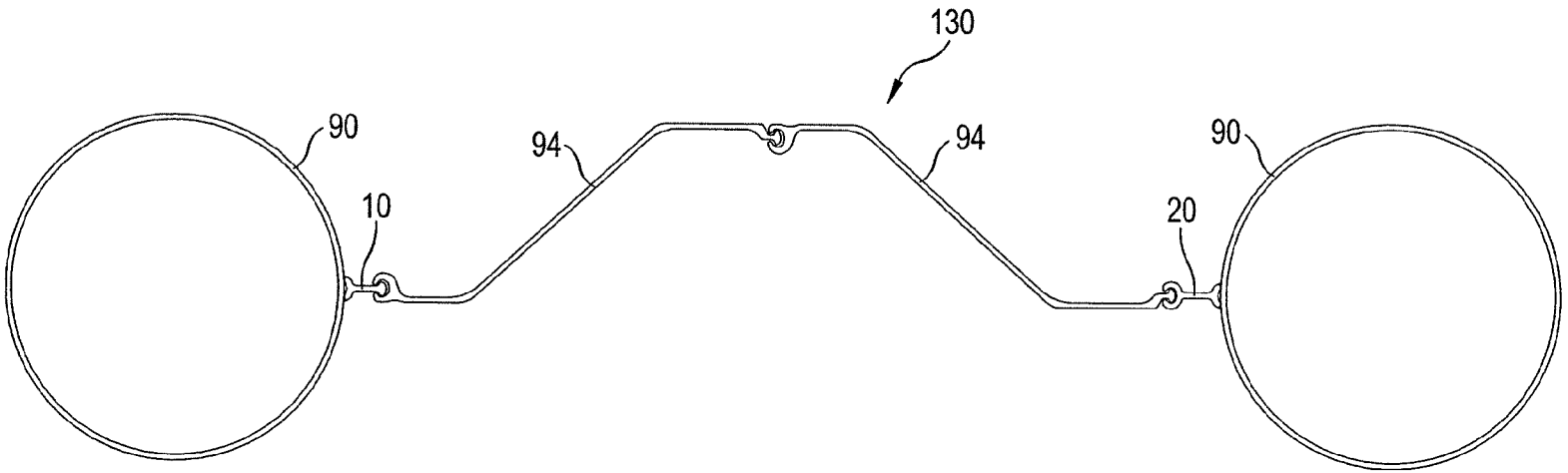
FIG. 10 top view of an assembly of two PZ sheet piles coupled together that are coupled to two tubular piles by means of the two connecting profile strips shown in FIGS. 1 and 2.

FIG. 10 shows a top view of an assembly 130 of two PZ sheet piles 94 coupled together that are coupled to two tubular piles 90 by means of the two connecting profile strips 10 and 20 shown in FIGS. 1 and 2.

Figure 11:
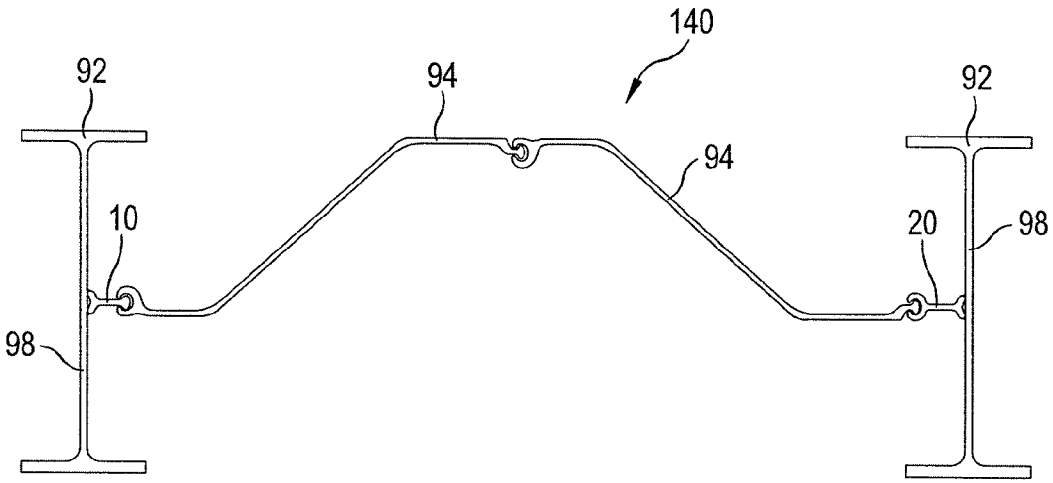
FIG. 11 top view of an assembly of two PZ sheet piles coupled together that are coupled to two double-T-carriers by means of the two connecting profile strips shown in FIGS. 1 and 2.

FIG. 11 shows a top view of an assembly 140 of two PZ sheet piles 94 coupled together that are coupled to two double-T-carriers by means of the two connecting profile strips 10 and 20 shown in FIGS. 1 and 2. For this, the two connecting profile strips 10 and 20 are welded to the spars 98 of the double-T-carrier 92.

Figure 12:
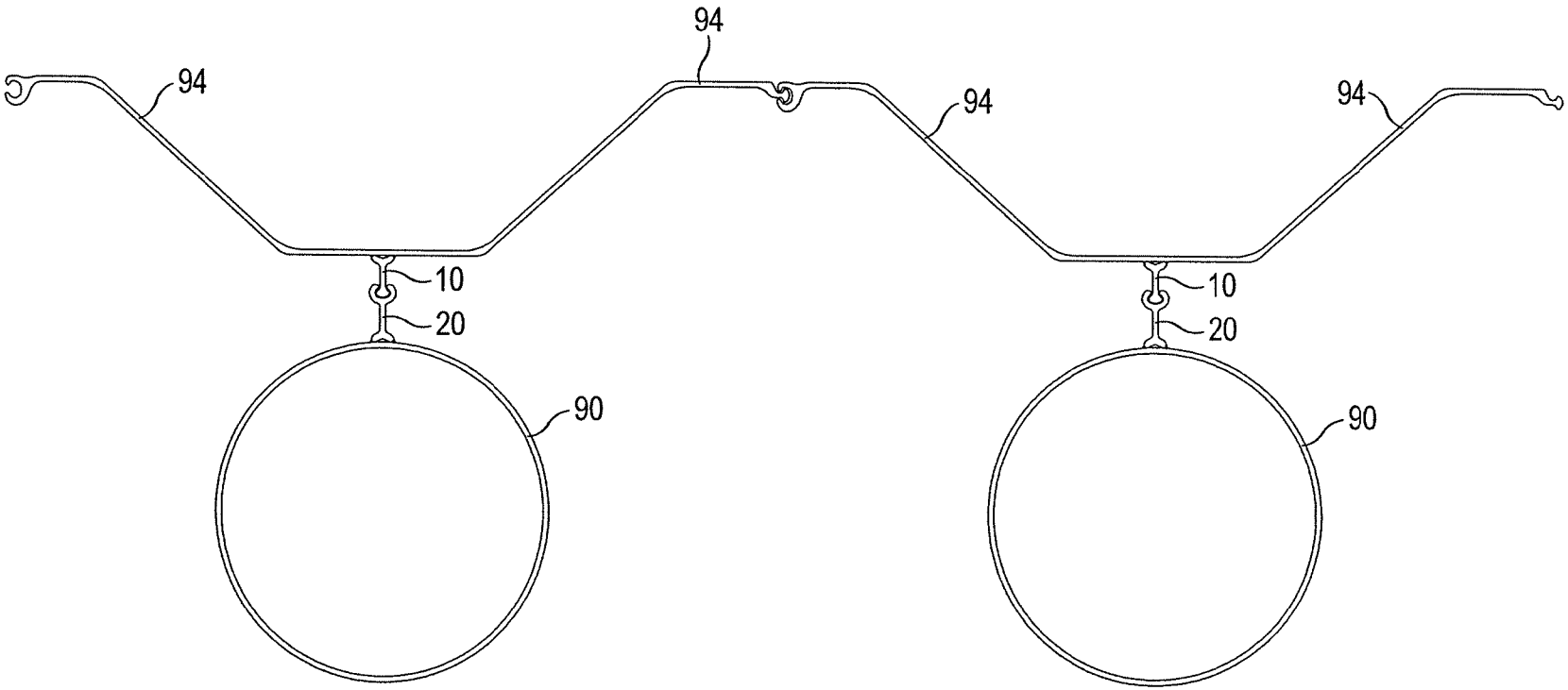
FIG. 12 top view of an assembly of four PZ sheet piles coupled together, whereby two of the PZ sheet piles are coupled to two tubular piles by means of the two connecting profile strips shown in FIGS. 1 and 2.

FIG. 12 shows a top view of an assembly 150 of a total of four PZ sheet piles 96 coupled together, whereby two of the PZ sheet piles 96 are coupled to two tubular piles 90 by means of the two connecting profile strips 10 and 20 shown in FIGS. 1 and 2.

The embodiments shown in FIGS. 5 through 12 show only a small portion of potential combinations. Particularly essential to the invention is the fact that the connecting profile strips 10, 20, 50, and 70 are so configured that they may be connected to conventional ball-and-socket joints or to themselves in a simple manner.

There has thus been shown and described a novel arrangement of multiple sheet pile components and welding profile therefor which fulfills all the objects and advantages sought therefor. many changes, modifications, variations and other uses and applications of the subject invention will, however, become apparent to those skilled in the art after considering this specification and the accompanying drawings which disclose the preferred embodiments thereof. all such changes, modifications, variations and other uses and applications which do not depart from the spirit and scope of the invention are deemed to be covered by the invention, which is to be limited only by the claims which follow.

What is claimed is:

1. Weld-on profile connector forming part of an elongate sheet pile connecting element for use in a sheet pile wall assembly comprising (a) a plurality of supporting, elongate sheet pile wall members with their longitudinal axes arranged substantially in parallel and disposed along a common horizontal line, and (b) a plurality of sheet pile connecting elements arranged in parallel with, and welded to, said sheet pile wall members, said weld-on profile connector comprising an elongate connecting member having (1) a base end configured to be welded to a sheet pile wall member, (2) an elongate neck strip having a length, extending from the base end along a predetermined main assembly direction (X) to an opposite end, which is greater than its width, and (3) a claw strip provided at an opposite end having two claw strip members that form a lock chamber for partially surrounding a head strip and whose free ends facing each other form a jaw, wherein the connector is a mirror-image about the main assembly direction (X).

2. Weld-on profile connector as defined in claim 1, wherein the claw strip is formed of two arc-shaped claw strip members that form a lock chamber to receive the head strip and whose free ends point toward each other and define a jaw.

3. Weld-on profile connector as defined in claim 2, wherein the center lines of the free ends of the two claw strip members intersect a symmetry axis of the claw strip at a point (S) outside the jaw.

4. Weld-on profile connector as defined in claim 3, wherein the distance from the intersection point (S) to the jaw is from 0.5 through 1.5 times the value of the wall thickness of the claw strip.

5. Weld-on profile connector as defined in claim 1, wherein the claw strip includes a cross spar extending perpendicular to the longitudinal direction of the neck strip, and two straight connecting strips extending at a distance from each other at least approximately perpendicular to the cross spar whose ends are formed into hook strips, with free ends that point toward each other and define a jaw of a lock chamber formed by the cross spar, the connecting strips, and the hook strips.

6. Weld-on profile connector as defined in claim 5, wherein the dimension (X) of the lock chamber viewed along the longitudinal direction of the neck strip corresponds to at least 0.5 the value of the length of the neck strip.

7. Weld-on profile connector as defined in claim 5, wherein a supply channel for sealing material is provided on the cross spar.

8. Weld-on profile connector as defined in claim 1, wherein the claw strip possesses a wall thickness of least approximately uniform thickness.

9. A pair of profile connectors with constant cross section viewed longitudinally used in an elongate sheet pile connecting element to connect two sheet pile wall members in a sheet pile wall assembly, the profile connectors comprising:

a first profile connector in the elongate sheet pile connecting element comprising a first elongate connection member having (1) a first base end capable of being welded to a first sheet pile wall member, (2) a first elongated neck strip extending from the first base end along a predetermined main assembly direction (X) to a first opposite end, and (3) a head strip of greater cross section provided on the first opposite end of the first elongated neck strip for engagement with a claw strip partially surrounding the head strip; and a second profile connector in the elongate sheet pile connecting element comprising a second elongate connection member having (1) a second base end configured to be welded to a second sheet pile wall member, (2) a second elongated neck strip having a length, extending from the second base end along the predetermined main assembly direction (X) to a second opposite end, which is greater than its width, and (3) a claw strip provided on the second opposite end of the second elongated neck strip for engagement to secure a head strip, wherein the second profile connection is a mirror-image about the main assembly direction (X).

10. The pair of profile connectors as defined in claim 9, wherein the head strip of the first profile connector serves both to secure a claw strip of a sheet pile wall member as a sheet pile wall component and to secure the claw strip of the second profile connector, and wherein the claw strip of the second profile connector serves both to secure a head strip of a sheet pile wall member as a sheet pile wall component and to secure the head strip of the first profile connector.

11. The pair of profile connectors as defined in claim 9, wherein the length of the first elongated neck strip of the first profile connector corresponds to the length of the second elongated neck strip of the second profile connector.

12. The pair of profile connectors as defined in claim 9, wherein the head strip of the first profile connector possesses an oval or round cross section, the claw strip of the second profile connector forms a lock chamber to receive the head strip, and the jaw of the lock chamber and the lock chamber itself are of such dimensions that the head strip and the claw strip are capable of being pivoted about the main assembly direction (X).

13. The pair of profile connectors as defined in claim 12, wherein the head strip and the claw strip are capable of being pivoted about the main assembly direction (X) at an angle in the range of ±15° to ±25°.

14. A pair of profile connectors with constant cross section viewed longitudinally used in a sheet pile connecting element to connect two sheet pile wall members in a sheet pile wall assembly, the profile connectors comprising:

a first profile connector in the sheet pile connecting element comprising a first elongate connector member having (1) a first base end capable of being welded to a first sheet pile wall member, (2) a first elongated neck strip extending from the first base end along a predetermined main assembly direction (X) to a first opposite end, and (3) a first claw strip provided on the first opposite end of the first elongated neck strip for engagement with a second claw strip engaging the first claw strip; and a second profile connector in the sheet pile connecting element comprising a second elongate connector member having (1) a second base end configured to be welded to a second sheet pile wall member, (2) a second elongated neck strip having a length, extending from the second base end along the predetermined main assembly direction (X) to a second opposite end, which is greater than its width, and (3) a second claw strip provided on the second opposite end of the second elongated neck strip for engagement with the first claw strip, wherein the second profile connector is a mirror-image about the main assembly direction (X).

15. The pair of profile connectors as defined in claim 14, wherein the first claw strip of the first profile connector serves both to secure a claw strip of a sheet pile wall member as a sheet pile wall component and to secure the second claw strip of the second profile connector, and wherein the second claw strip of the second profile connector serves both to secure the first claw strip of a sheet pile wall member as a sheet pile wall and to secure the first claw strip of the first profile connector strip.

16. The pair of profile connectors as defined in claim 14, wherein the first claw strip of the first profile connector and the second claw strip of the second profile connector each form a lock chamber to partially receive the other claw strip, and the lock chambers are of such dimensions that the first and second claw strips are capable of being be pivoted about the main assembly direction (X).

* * * * *